US010259250B2

(12) United States Patent
Altenbach et al.

(10) Patent No.: US 10,259,250 B2
(45) Date of Patent: Apr. 16, 2019

(54) METHOD AND MACHINE FOR PRODUCING ADHESIVE-BOUND PRINTED PRODUCTS

(71) Applicant: MUELLER MARTINI HOLDING AG, Hergiswil (CH)

(72) Inventors: Dieter Altenbach, Vordemwald (CH); Mark Rickenbacher, Sissach (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 196 days.

(21) Appl. No.: 15/259,713

(22) Filed: Sep. 8, 2016

(65) Prior Publication Data

US 2017/0066273 A1 Mar. 9, 2017

(30) Foreign Application Priority Data

Sep. 9, 2015 (CH) ..... 1315/15

(51) Int. Cl.
*B42C 1/12* (2006.01)
*B42C 11/04* (2006.01)
(Continued)

(52) U.S. Cl.
CPC ..... *B42C 99/00* (2013.01); *B42C 1/12* (2013.01); *B42C 9/0006* (2013.01); *B42C 11/04* (2013.01);
(Continued)

(58) Field of Classification Search
CPC ..... B42C 19/00; B42C 19/02; B42C 1/12; B42C 11/04
(Continued)

(56) References Cited

U.S. PATENT DOCUMENTS 6,206,358 B1 * 3/2001 Yamaguchi ..... B42C 19/02 412/11
6,250,868 B1 * 6/2001 Schmucker ..... B42C 19/00 412/9
(Continued)

FOREIGN PATENT DOCUMENTS

DE 10 2008 033184 A1 3/2010
DE 102008033184 B4 * 2/2018

OTHER PUBLICATIONS

DE102008033184 Translation (Year: 2008).*
International Search Report for CH 01315/15, dated Nov. 17, 2015.

*Primary Examiner* — Kyle R Grabowski
(74) *Attorney, Agent, or Firm* — Fisherbroyles, LLKP; Robert Kinberg

(57) ABSTRACT

A method for production of adhesive-bound printed products in a machine belonging to an adhesive-binder line. To change over from one job under production to a following job, supplied printed products of the following job are detected via a barcode and stopped prior to being fed into the machine of the adhesive-binder line. Remaining printed products of a preceding job are moved and fully processed through individual processing stations of the machine while the printed products of the following job remain in a waiting position in front of the machine. After completing the last printed product of the preceding job, an empty withdrawal of covers stored in a cover deposit and belonging to the following job is initiated until it is ensured that the stored covers are available for the printed products of the following job. After determining that a withdrawn cover securely matches the printed products of the following job, stopped printed products of the following job are released with a main control and fed into the machine for being processed via the individual processing stations.

22 Claims, 12 Drawing Sheets

(51) Int. Cl.

| | |
|---|---|
| ***B42C 19/00*** | (2006.01) |
| ***B42C 19/02*** | (2006.01) |
| ***B42C 99/00*** | (2006.01) |
| ***B42C 9/00*** | (2006.01) |
| ***B42C 19/08*** | (2006.01) |

(52) U.S. Cl.
CPC ..... *B42C 19/00* (2013.01); *B42C 19/02* (2013.01); *B42C 19/08* (2013.01)

(58) Field of Classification Search
USPC ..... 412/4–5, 11, 19–21
See application file for complete search history.

(56) References Cited

U.S. PATENT DOCUMENTS

| | | | | |
|---|---|---|---|---|
| 2006/0028662 | A1* | 2/2006 | Dobrovolsky | B42C 19/02 358/1.9 |
| 2008/0138170 | A1* | 6/2008 | Sturnick | B42C 19/02 412/4 |
| 2010/0111643 | A1* | 5/2010 | Schmidkonz | B42C 11/04 412/3 |
| 2010/0239392 | A1* | 9/2010 | Adler | B42C 19/08 412/6 |
| 2011/0280690 | A1* | 11/2011 | Mueller | B42C 19/08 412/19 |
| 2012/0257946 | A1* | 10/2012 | Mueller | B42C 19/08 412/1 |
| 2013/0235425 | A1* | 9/2013 | Abegglen | B42C 19/02 358/1.15 |
| 2015/0197403 | A1* | 7/2015 | Moesli | B42C 19/08 198/464.4 |

* cited by examiner

METHOD AND MACHINE FOR PRODUCING ADHESIVE-BOUND PRINTED PRODUCTS

CROSS-REFERENCE TO RELATED APPLICATION

This application claims priority to Application No. 01315/15 filed in Switzerland on Sep. 9, 2015, the disclosure of which is incorporated herein by reference in its entirety.

BACKGROUND OF THE INVENTION

Technical Field

In the post-processing of digitally printed signatures or sheet stacks to form books, the seamless production of multiple jobs without having to retrofit or convert the equipment is increasing in importance. This is even more important when there is considerable variation in the print runs, i.e. the respective number of books per job order, including small editions or even a single book.

In the digital environment, this development is rapidly becoming more important. With this development, the job-related setup has a strong effect on the net production capacity of a production line and is becoming a decisive factor with respect to economic efficiency.

In order to assure that the book block and cover of even the smallest editions always match and are processed perfectly, no compromise can be accepted in quality assurance.

The invention relates to a method for producing adhesive-bound printed products in a machine belonging to an adhesive binder line which essentially consists of a book spine processing station, an adhesive application station, a pressing station, a cover feeder from which a hardcover is pulled, wherein the processes for producing the adhesive-bound printed products are controlled with the aid of control profiles.

Prior Art

According to the prior art, the setup for processing a job and/or the conversion for processing subsequent jobs are done manually, such that far-reaching manual provisions are required in most cases to ensure that book blocks and covers match after each job change. The covers and books blocks of a preceding job must therefore be removed completely from the machine, so that the components belonging to a following job can be fed in. Of necessity, this results initially in a shutdown of the plant operation.

With respect to quality assurance, in particular concerning matching of the book block and cover, a cover-match system (CMS) is known in the prior art. A great disadvantage of such a system is that while it detects a mismatch, correcting the mismatch requires an involved manual intervention which can lead to potential inaccuracies.

Quality assurance can also be affected because long shutdown periods for an adhesive binder belonging to the adhesive-binding line, so-called cold books can be created which must be removed from the production line. The best counter remedy is therefore to prevent a mismatch before the book block and/or the cover are fed into the machine.

SUMMARY OF THE INVENTION

An object of the invention is to produce adhesive-bound printed products, henceforth also called book blocks, for which the dimensions and job sizes vary, with a minimum standstill time in-between individual jobs. The printed products can also comprise brochures, magazines and the like.

The above and objects are solved according to the invention, wherein according to one embodiment there is provided a method for producing adhesive-bound printed products in a machine belonging to an adhesive-binder line, the machine having individual processing stations including a book spine processing station, an adhesive application station, and a pressing station with a cover that is withdrawn from a cover feeder, wherein the method for producing the adhesive-bound printed products is controlled by control profiles, the method comprising:

a) to changeover from one job under production to a following job, detecting supplied printed products of the a following job via a barcode and stopping the following job prior to being fed into the machine of the adhesive-binder line;

b) moving and fully processing remaining printed products of the one job through the individual processing stations of the machine while the printed products of the following job remain in a waiting position in front of the machine;

c) after completing a last printed product of the one job, initiating an empty withdrawal of covers stored in a cover deposit and belonging to the following job until it is ensured that the stored covers are available for the printed products of the following job; and d) after determining that a withdrawn cover securely matches the printed products of the following job, releasing, with a main control of the adhesive-binder line, stopped printed products of the following job, and feeding the released printed products into the machine for being processed via the individual processing stations.

As used herein, the phrases "empty withdrawal of covers" and "discharge of empty covers" both mean that excess covers in connection with one job are removed from the stacking without having an immediate use for a printing product, so-called "empty" for the intended use.

With the example of an adhesive-bound printed product, produced in this case with a machine forming a component of an adhesive-binder line (wherein for the sake of simplicity the machine is henceforth, but not exclusively, also called adhesive binder or adhesive-binding machine), the invention is based on supplying a printed product to an adhesive-binding process, but only after it is certain that the correct cover for use with the pressing operation is available. In this connection, the conversion between two jobs can easily be automated.

Based on the provisions according to the invention, the correct cover that matches the printed product to be processed is called up, wherein the opposite action is possible as well, meaning that based on an available cover, the corresponding printed product is supplied and/or released.

The inventive idea is realized using barcode information, known per se from the prior art, which is affixed, so as to be readable, to the printed product as well as the cover with the final purpose of clearly reflecting the job assignment.

An adhesive binder essentially consists of a series of processing stations, for the most part arranged along a simple straight-line, or round or oval transport path, wherein it is also possible that the processing stations are positioned along several such transport paths.

Adhesive binders of this type are therefore used in the production of adhesive-bound brochures or book blocks for hardcover books, wherein the folded sheets and/or individual sheets collated into a book block are joined by applying adhesive to the pre-processed book block spine.

Possible binding methods and product variants depend on the equipment used. As previously mentioned, the equipment used consists essentially of different processing stations which need not always be arranged along a single track.

According to the prior art, an adhesive binder usually comprises the following processing stations: a book block spine processing station, an adhesive application station, a station for fitting on the cover, a pressing station for attaching the cover. Added to this may be complementary elements, such as a book block transporting system, a book block feeding station, an intermediate drying station, a spine reinforcement station, and others, wherein this list of processing stations should not be considered final or exhaustive.

The start of the processing of a specific printed product is based on the following inventive processing steps:

With a changeover from the production of a currently processed job to a following job, the printed products (henceforth also called book blocks) supplied for the following job are acquired via barcode and are initially stopped before being fed into the machine (henceforth called adhesive binder);

While the printed products for the following job remain in a waiting position, the remaining printed products of the preceding job are guided through the processing stations of the adhesive binder and are fully processed;

Following the final printed product of the preceding job, an empty withdrawal of covers is initiated with the final purpose that the covers are securely available for the printed products of the following job;

As soon as the last withdrawn cover matches the printed product of the following job, the main control unit for the adhesive binder releases the stopped printed products of the following job which are then fed into the adhesive binder and are processed via its processing stations to finished hardcovers, mostly books.

The adhesive binder is to be configured such that the processing stations can be adapted quickly, with a minimum of expenditure, to the new printed products to be processed if the goal is to produce different types of printed products. According to the invention, the printed products from various jobs can be processed based on the following processes and/or criteria:

1. Different jobs use the same printed products; but the intended cover is designed individually, depending on the job:

If a new printed product is detected via the barcode during a running production, the printed products belonging to this job are initially also stopped before being fed into the adhesive binder;

The remaining printed products of the preceding job are moved through the individual processing stations of the adhesive binder and are processed fully;

As soon as the last cover belonging to the preceding job is withdrawn, the cover belonging to the following job is first made available, wherein the withdrawal process must ensure that the new cover is permanently available for the following job and that it is not only an intermediary, isolated cover;

Once the covers for the printed products of the following job are securely available, the previously stopped printed products are released, which are then moved through the processing stations of the adhesive binder and are processed fully;

The preparations for a sustained production of a following job are thus completed, and the production of the printed products for this job can take place.

2. The printed products to be produced for an additional job (job C) only differ with respect to thickness from those of the preceding jobs (jobs A; B):

These printed products (job C) are identified with the aid of the barcode and are also stopped initially before entering the adhesive binder;

The remaining printed products of the preceding job are processed fully;

As soon as the last cover belonging to the preceding job has been withdrawn, the cover belonging to the following job (job C) is initially supplied to ensure that the new cover is available for the complete production of this job and that it is not an intermediary, isolated cover;

Once the cover for this job C is available, it must first be ensured that the location of the grooves is adapted to conform to the thickness of the printed product for the new job C. Only then are the stopped printed products released for the processing in the adhesive binder;

The retrofitting or conversion for the job C is then considered completed.

The job C relates to printed products which differ only with respect to thickness from the printed products of the preceding job. The cover feeder, the pressing station and the discharge station of the adhesive binder are designed according to the invention to handle thickness differences between the printed products in the range of +/−3.25 mm without requiring extensive retrofitting. The range of +/−3.25 mm means that greater thickness differences, e.g. above +/−3.25 mm as compared to the original book block thickness, can also be processed at any time without conversion.

When producing printed products of different thicknesses, the grooves, insofar as they are needed, are inserted such that the text on the back of the cover belonging to the respective printed product is positioned to match the job order. The grooving device is designed to continuously make these adaptations, without causing delays in the production cycle or the installation.

For printed products (job D) for which the thickness differences exceed the maximum detectable dimensions, as compared to the preceding jobs, or if such printed products (job E) differ in format from the preceding ones, then these printed products are initially also stopped. The remaining printed products from the preceding job are processed fully as usual and, prior to providing the correct cover, a corresponding conversion is initiated of the directly affected processing stations in the adhesive binder. However, this conversion along with a secure providing of the correct cover can also take place simultaneously.

The required number of idle cycles for the above-described processes (jobs A-E) follow exclusively based on the one-time stopping of the printed products belonging to a new job. The production for realizing the respective job is monotonous and no further idle cycles are required.

Since the idle cycles during the stopping of the printed products at most correspond to the number of operatively effective processing stations of the adhesive binder, the production interruption is always limited, regardless of the size of the job.

It must be viewed as an advantage for this configuration that the ratio between adjustment section and processing section along the conveying track of the adhesive binder need not be varied, thereby resulting in simplifying and stabilizing the installation. According to the invention, the time required for the idle cycles necessary for a job change is of subordinate importance for different reasons as well. In most cases, the conversion of the various processing stations of the adhesive binder cannot be realized within a single idle cycle.

If very small jobs are to follow successively in an extreme case, it is proposed according to the invention to scan in the covers externally ahead of time and transmit the resulting sequence electronically to the main control unit of the adhesive binder and/or the adhesive binder line. The printed products released for processing are then dependent on the scanned-in sequence for the covers.

If the sequence and the number of scanned-in covers correspond precisely to the size of the job to be processed subsequently, a continuous production can be maintained without idle cycles.

Scanning-in the covers ahead of time also allows laying out the job sizes accordingly. That is to say, the job size can be adjusted to the number of available covers in favor of an operation without idle cycles, wherein it must be judged case by case whether canceling the idle cycles does not result in extending the production time to fully complete the job.

In any case, the invention does not exclusively focus on reducing the idle cycles which would make little sense if it results in a reduction of the quality.

A further essential advantage of the invention is that printed products with differing thicknesses within a specific belt width can be produced continuously, without intervention, namely that printed products with thickness differences up to at least +/−3.25 mm can be produced without intervention before a change to a wider and/or narrower belt width for larger and/or smaller book blocks becomes necessary. This course of action always corresponds to the above-explained operational processes, meaning that the respectively next wider or narrower belt width once more ensures that thickness differences of at least +/−3.25 mm for the printed products are covered.

Adhesive-bound printed products of this type can advantageously be produced using the digital printing technique. With a high-performance system of that type, where the digital printing and the post-processing are interconnected to form a total system, it is possible to offer a fully automated production in a single operation, starting from the paper roll to the finished printed product, thus also allowing the quick and economic production of even the smallest editions.

The aforementioned high-performance system is very suitable for providing a fully integrated total solution for the digital book production which, as previously mentioned, can operate in an economic manner, even for producing the smallest editions. The data control and regulate the pre-press stage, the digital printing and the post-processing of the printed products in a high-performance adhesive binder, up to the finishing of the book blocks or brochures.

If the characteristics, detected electronically via the barcode, of the printed products that are initially in the waiting position indicate the necessity for a conversion and/or adaptation for one or several of the processing stations of the adhesive binder, these interventions can be introduced and realized continuously, respectively as soon as the last printed product of a preceding job has left this processing station.

The processing of the printed products for the following job can thus start directly, as soon as the main control unit receives the information that the corresponding covers for the new job are ready for withdrawal. If the cover information is scanned in ahead of time, as described in the above, making sure ahead of time that the covers are available is generally not necessary.

The values upon which these adaptations are based can be called up directly, insofar as the control profiles to be used are stored in the main control unit for the adhesive binder line. If no stored control profiles are available for a specific printed product, the electronically detected features and/or characteristics of the printed product to be processed ensure that the main control unit transmits the matching control profiles to the machines and processing stations of the adhesive binder line, wherein these can then be implemented directly and automatically.

Of course, this necessitates that at least the processing stations are equipped with corresponding servo-motors which can store the commands in the control technology so that they can be implemented precisely point by point. This storage per se meets the condition of a stored control profile. The electronically acquired features of the respective printed product can be detected with sensors or they are encoded in a barcode. If the processing stations are equipped with corresponding servo-motors, manual adjustments are completely unnecessary.

The stored control profiles can also be designed such that they can be checked, adapted and/or immediately corrected in dependence on feedback from a processing station. The following advantages can be achieved with a high-performance system of this type:

- economic production of even the smallest editions;
- integrated and continuous line control;
- intelligent networking of all partial processes, starting with the data of the pre-press stage via the digital printing and the post-processing to the finished adhesive-bound printed product;
- maximum degree of automation;
- industrial construction for the multiple-shift operation;
- highest quality of the finished product even for the smallest editions.

In summary, the invention comprises the following additional processes:

A conversion of the processing stations and/or the machines of the adhesive-binder line for the production of the printed products belonging to the following job occurs through activating the control profiles before the stopped printed products are released.

For each additional job to be processed, the same processing steps are used as for one of the preceding jobs.

Any accumulating excess covers of the preceding job can be removed through continuous discharge of the empty covers, until the first cover for the printed products of the following job is securely available.

The stopping times indicated by the stopped products of the following job can be minimized by electronically detecting the sequence of the provided covers via barcode and transmitting the resulting information to the main control unit of the adhesive binder line.

An uninterrupted production can be maintained if the number and sequence for the covers matches the number and sequence of the upcoming jobs.

Electronically acquiring the sequence for the covers in this way also leaves open the option that the sequence for the printed products introduced into the adhesive binder is determined by the sequence of the detected covers.

With identically dimensioned printed products for which only the covers are different, the processing stations within the adhesive binder are not converted, as mentioned in the above.

A further advantage of the invention is that if the thickness of a printed product changes for different jobs, the original settings for the processing stations within the adhesive binder remain unchanged, up to a belt width of at least +/−3.25 mm.

The conversion of the processing stations is carried out only if the width and height of a printed product have changed and its thickness at once exceeds the minimum range upon which the thickness is based (at least +/−3.25 mm).

A change in the thickness of the printed product that exceeds a specific measure, it is possible to provide for an adaptation of the geometric location of the grooves on the covers, insofar as this is necessary for quality reasons.

In addition, if the cover consists of a barely flexible material, the cover is usually subjected to a folding operation ahead of time which corresponds to the spine thickness of the book block.

With changed dimensions for the printed products, the processing stations of the adhesive binder and, if necessary, other machines of the adhesive-binder line, are converted to meet the technical requirements of a subsequent job, wherein the conversion takes place based on control profiles which are stored in the main control unit or which are computed. This conversion can take place continuously, meaning dynamically, at each processing station as soon as the last printed product of the preceding job has left this processing station.

To realize the above-mentioned processes, an adhesive binder is proposed for which a central drive shaft that extends through the complete adhesive binder forms the drive for the individual processing stations. An adhesive binder can furthermore be provided for which the individual processing stations are operated with respectively at least one individual drive.

With the aforementioned adhesive binders, the conversions for realizing the individual jobs can per se be effected manually or semi-manually at the individual processing stations.

However, it is also possible to provide adhesive binders for which the processing stations, if necessary also the other machines of the adhesive-binder line, can be operated based on control profiles transmitted by the main control unit or made available directly by the respective drive units. These control profiles can be changed continuously or replaced during the course of the processing operations.

BRIEF DESCRIPTION OF THE DRAWINGS

All elements Figures essential to the invention are listed and briefly addressed in the following. not needed for the direct understanding of the invention are omitted. The same elements in different Figures are provided with the same reference numbers.

DETAILED DESCRIPTION OF THE INVENTION

Figure 1:
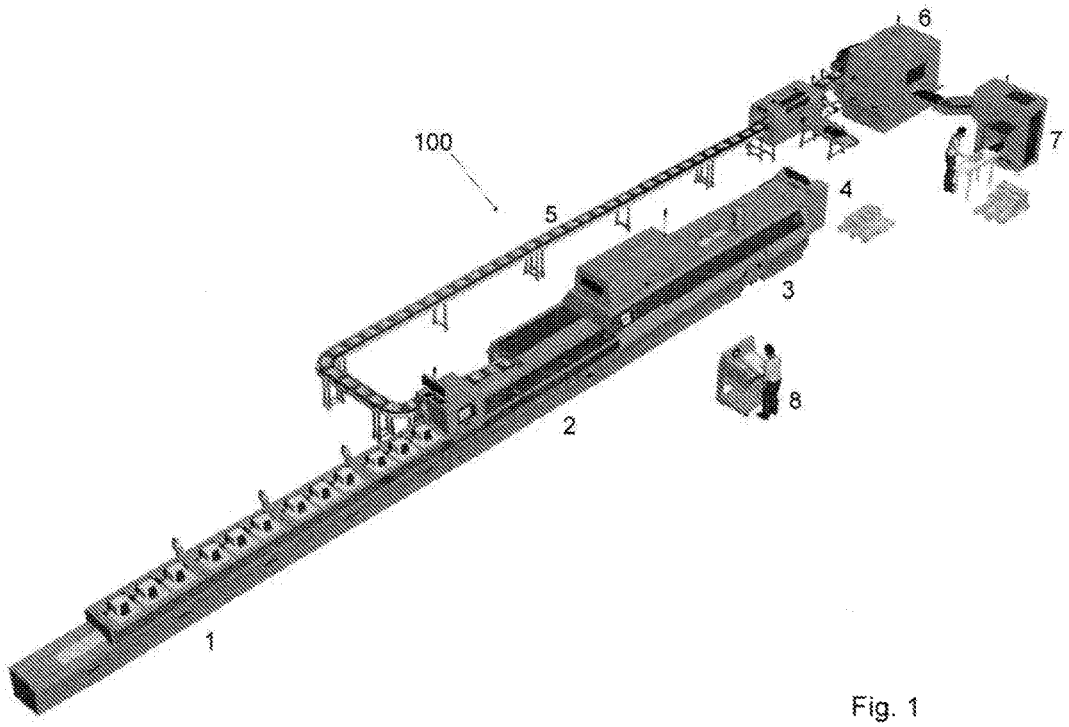
FIG. 1 shows an adhesive-binder line.

FIG. 1 shows an adhesive-binder line 100 configured with different machines, wherein the central adhesive binder machine comprises respectively a number of processing stations for processing printed products into books, brochures and the like.

Basically, the adhesive binder line 100 is composed of a collating machine 1, a downstream arranged section with transfer elements 2, an adhesive-binder machine 3 that is again arranged downstream and comprises a number of operatively connected processing stations in which the printed products are processed into books, brochures and the like. An adhesive-binder machine of this type, in professional jargon is simply called an adhesive or perfect binder, comprises at least the following processing stations: a book spine processing station, an adhesive application station, a cover feeding station 4, and a pressing station. In FIG. 1, of the various processing stations of the adhesive-binder machine 3, only the cover feeding station 4 is separately numbered, the other referenced stations, namely the book spine processing station, adhesive application station and pressing station are all comprehended by the reference number 3 applicable to the adhesive-binder machine.

A further machine of the adhesive-binder line 100 is the delivery section (also referred to herein as "discharge machine") 5, arranged downstream of the adhesive-binder machine 3, which also serves as a cooling section. The printed products are then advantageously supplied to a three-knife trimmer machine 6 where the products are processed to format by trimming the top, bottom and front sections, preferably successively, but in part also simultaneously. A stacker machine 7 can subsequently be provided as an additional machine. Shown in FIG. 1 is also a central book data acquisition device 8, which is used to input the orders (jobs) based on different criteria and/or to prepare them.

The aforementioned processing stations of the illustrated adhesive-binder machine 3 within the adhesive-binder line 100 can basically be operated via a centrally running drive shaft, such that this shaft substantially extends through the total adhesive-binder machine 3, thereby ensuring the drives for the individual processing stations within the adhesive binder. If applicable, the processing stations are supplemented by local digital panel(s).

The adhesive-binder machine 3 can furthermore be configured such that the processing stations can be operated with one or several individual drives, for example traveling wave motors or servomotors.

Regardless, meaning independent of how the processing stations are operated, the adhesive-binder machine 3 in principle operates with a so-called timing adjustment that determines the selection of the so-called "pressing moment." This can be achieved with a single, unchangeable control profile, wherein the optimizing occurs simply through adjusting of the pressing moment based on a one-time, direct input by the operator. The pressing in the pressing station is therefore based on an adjustable pressing moment which does not have to be influenced or superimposed by different process parameters.

The pressing moment can be adjusted through a simple manual input by the operator, within the meaning of an adaptation in a plane. Further adaptations based on other operating parameters do not take place. In that case, the drive connected to the fixed pressing moment continuously runs the original settings monotonously and unchanged during the following production. However, this can also be realized with movement values obtained with the aid of a mechanical sensor.

However, the adhesive binder can also be operated based on changeable control profiles, meaning a controlled adjustment is carried out within the processing stations and the complete units or elements connected thereto, based on the determined parameters. In that case, the movement of the pressing bars acts as a movement profile, representing the result of introduced parameters, meaning the changeable movements of the pressing bars are parameter-dependent movement profiles.

The control profiles for operating the processing stations can be pre-determined and stored in an electronic memory and can then be assigned to specific jobs to be processed. In addition or alternative thereto, the control profiles can be computed individually in dependence on the specific jobs to be processed, meaning in dependence on specific parameters, e.g. a movement or a movement profile for the pressing table, book block thickness, offset, intake width, pressing position, pressing time length and/or pressing force, respectively pressure, which can be implemented directly as changed control profiles or can be transmitted further to the main control unit. The servomotors used in the different processing stations can furthermore be provided with a separate, preferably integrated control unit. The underlying algorithms for the control profiles can acquire all possible parameters from the adhesive binder operation, based on which the algorithms can provide a new movement profile for the respective controlled operation. Insofar as the servomotors serve as drive units for a processing operation, they can be admitted with control profiles that are called up and/or are changeable, if applicable also replaceable.

During the pressing operation, for example, the introduced speed, the developing power, and the pressure profile of the pressing element or elements can be adapted to the printed product to be produced or manufactured, thus resulting in a higher quality for these products.

At least the adhesive binder, preferably the complete adhesive-binder line, is furthermore operated with a "motion control," which refers to the manner in which the drive is called up for the individual processing stations within the adhesive binder. It means that in place of the above-described central drive shaft extending through the complete adhesive binder, where the drives for the individual processing stations can be tapped, separate drives can be used for the processing stations.

The separately driven processing stations, such as the book spine processing station, the adhesive application station, the cover feeder and the pressing station for the adhesive binder 3, are connected via a transport system provided with a plurality of clamps for clamping in book blocks, page stacks, gathered signatures or the like. These clamps are advantageously driven individually along a guide track and are operated with the aid of traveling wave motors, meaning linear motors, or servomotors. The transport system for the adhesive binder is provided with a control unit for controlling the speeds of the respective clamps. As a result, each clamp can be moved with a separate speed along the guide track. According to a further and especially advantageous embodiment, the speeds of the clamps are controlled in dependence on the various parameters, including the position of the clamp within the book-binding machine. The clamp can thus move slower in the processing stations and faster in pure transport sections. The speed can furthermore be controlled in dependence on the product thickness. For an exact processing of thick books in the book spine processing station, the speed can thus be reduced. A further parameter can be the viscosity of the adhesive used in the adhesive application station. More generally viewed, an optimum processing speed exists for each processing station and the associated processing tools.

Figure 2:
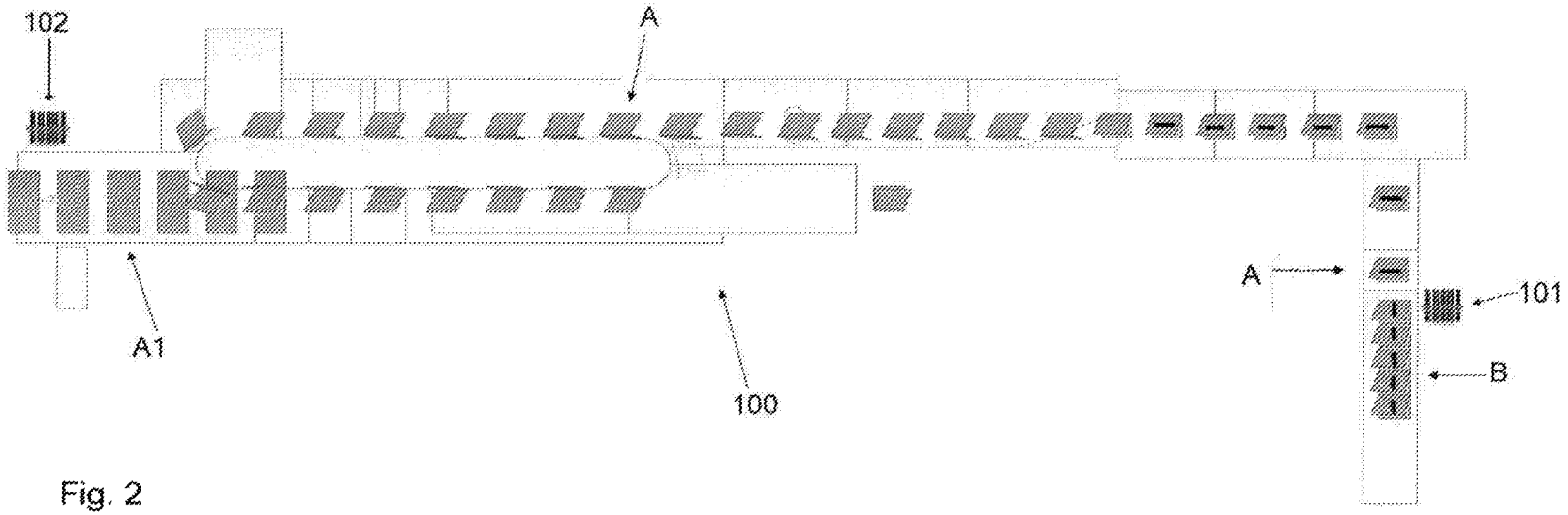
FIGS. 2-12 illustrate the process-related interdependence between a preceding and a following job, in connection with providing the correct covers.
Figure 3:
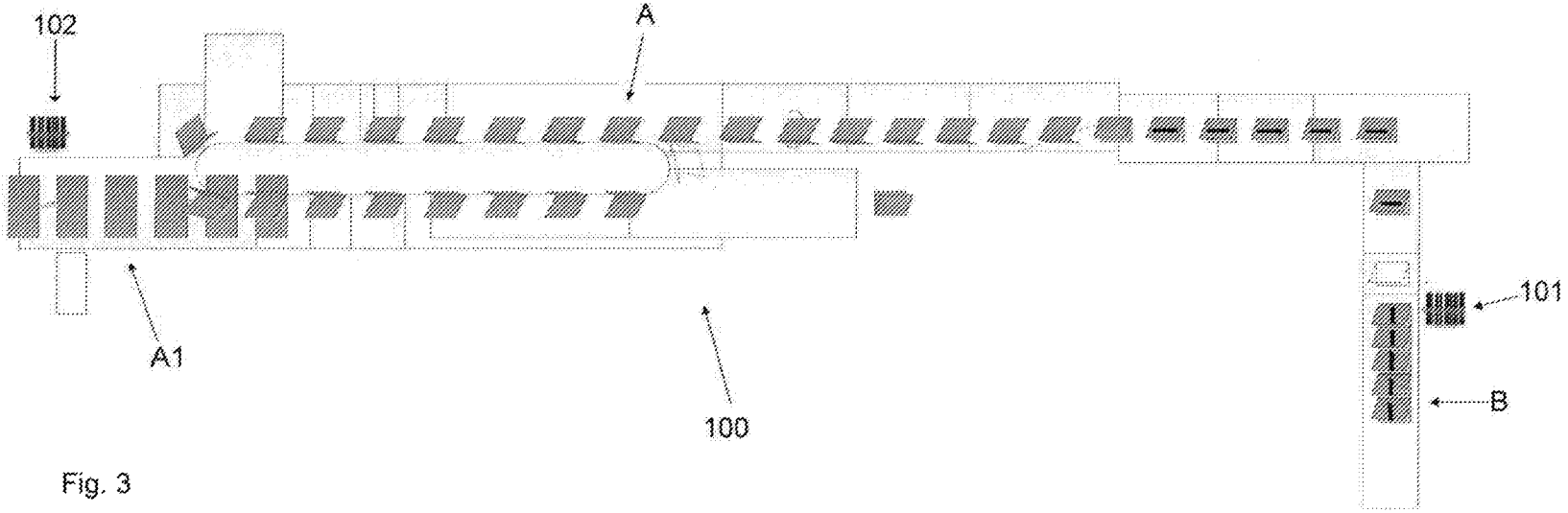
Figure 4:
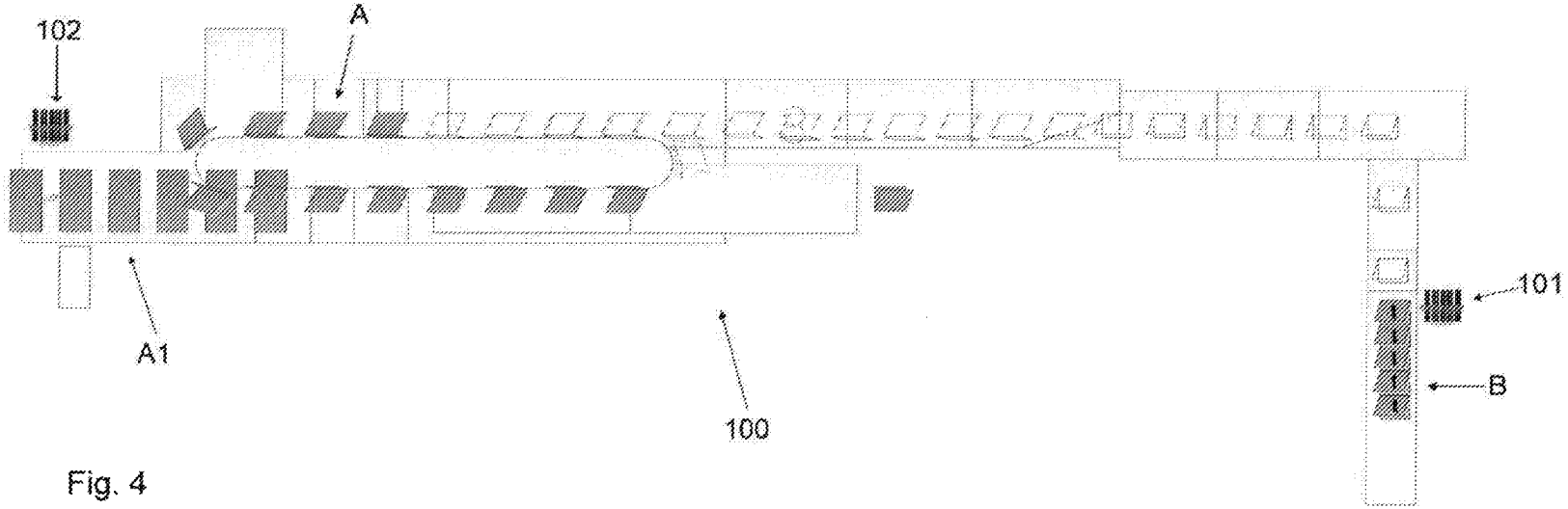
Figure 5:
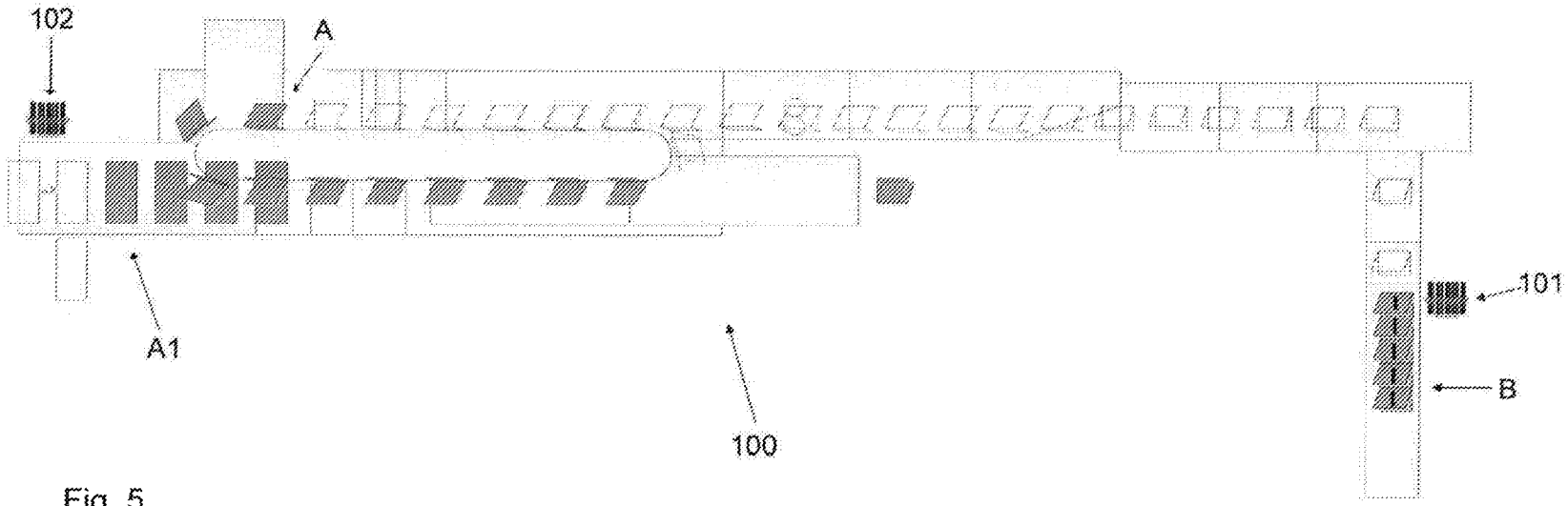
Figure 6:
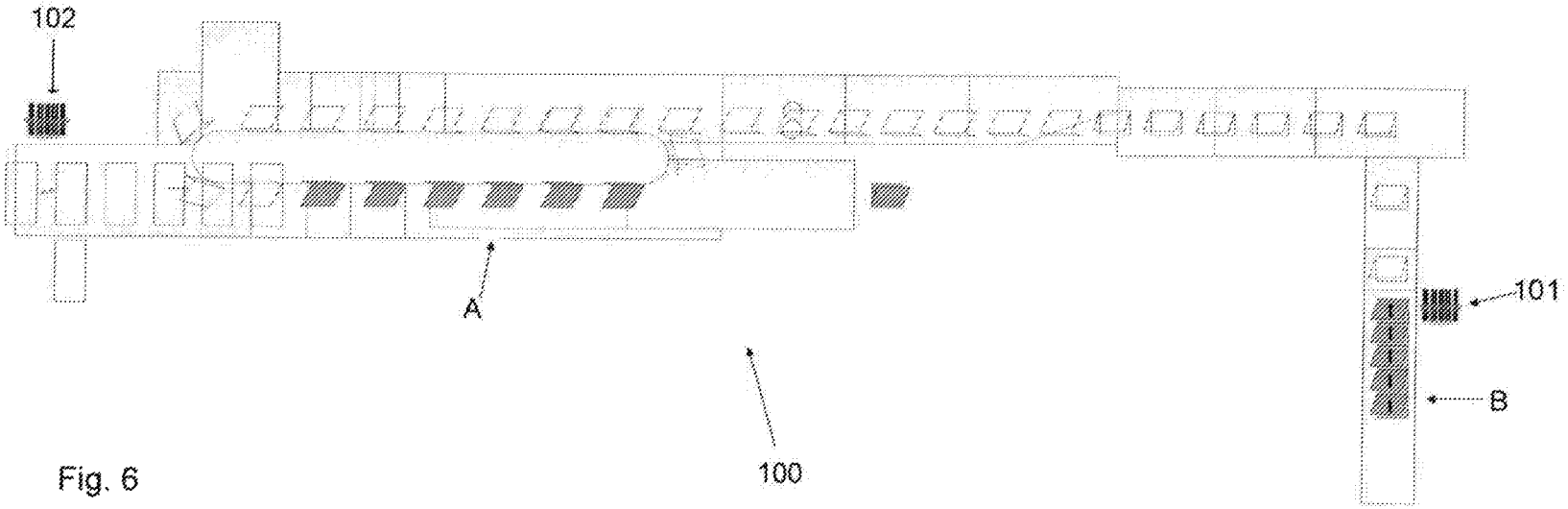

FIG. 2 shows a stylized version of the production of a first job A (supplemented by a horizontal line for better characterization) in the adhesive binder 3, with the associated covers A1 from the cover feeder 4 (see FIG. 1), wherein the feeding of these covers is monitored by a control location 102. The Figure furthermore shows that the printed products follow which belong to a subsequent job B (supplemented by a vertical line for better characterization).

With this type of production, the printed products belonging to a subsequent job B are acquired via barcode in the region of a control station 101 and are then stopped prior to being fed into the adhesive binder 3.

While the printed products of the following job B remain in the waiting position upstream of the adhesive binder 3, the remaining printed products of the preceding job A are guided through the individual processing stations, as listed in the above, and are fully processed.

Figure 7:
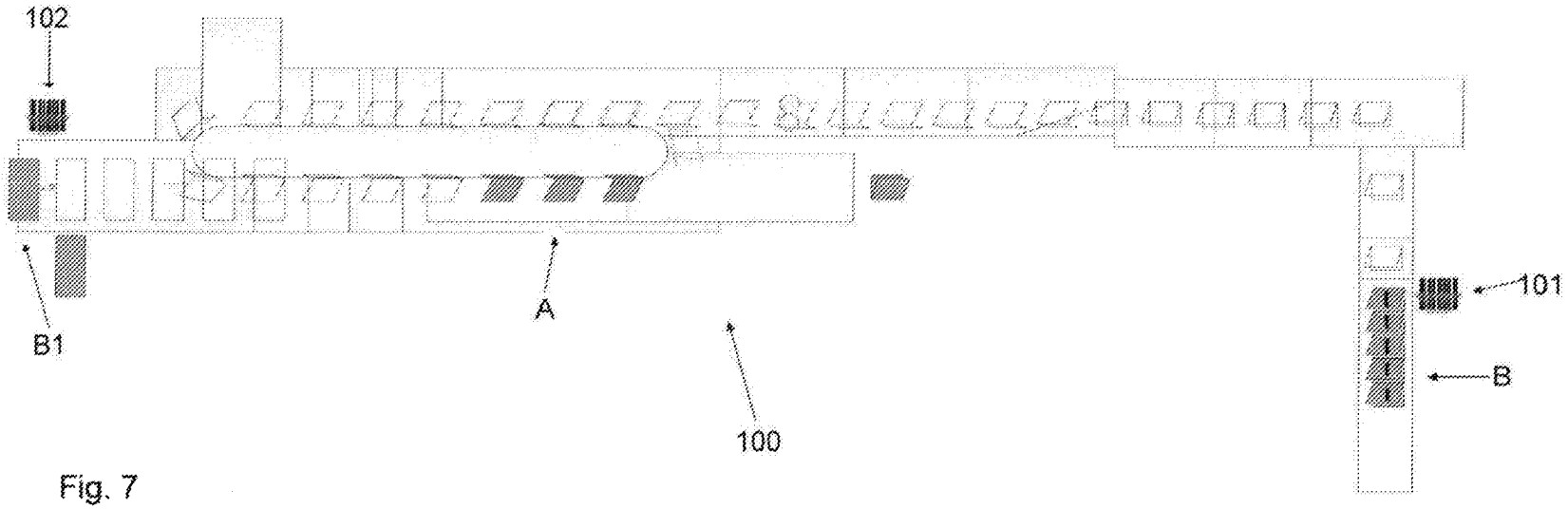
Figure 8:
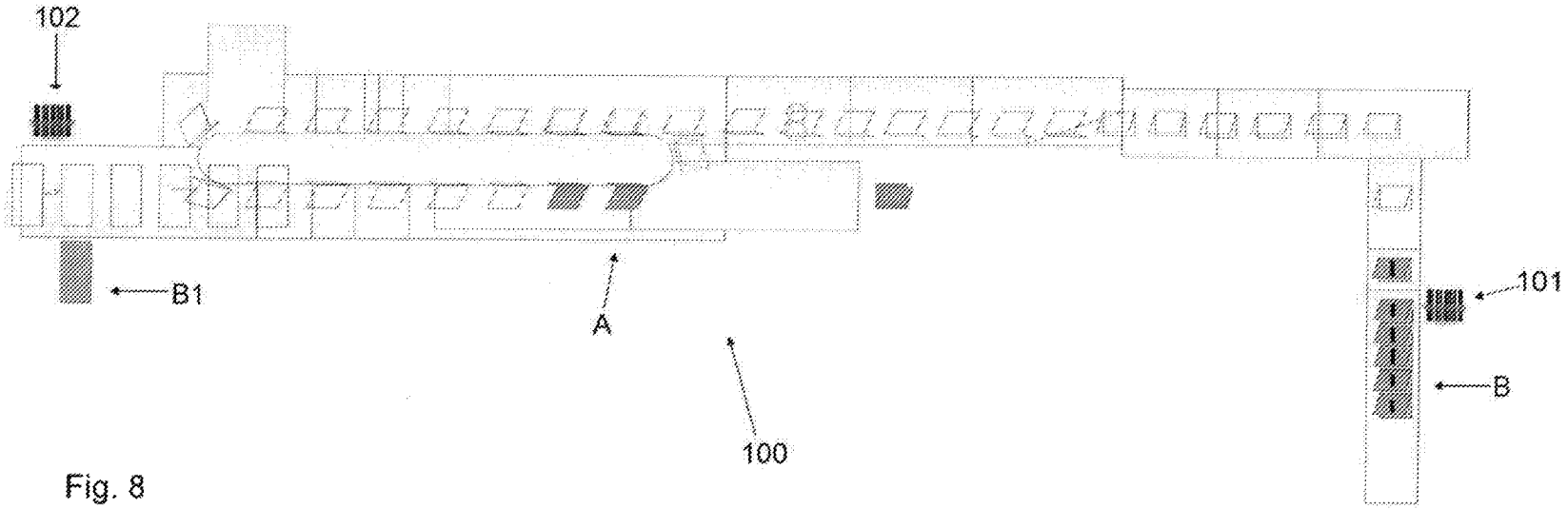
Figure 9:
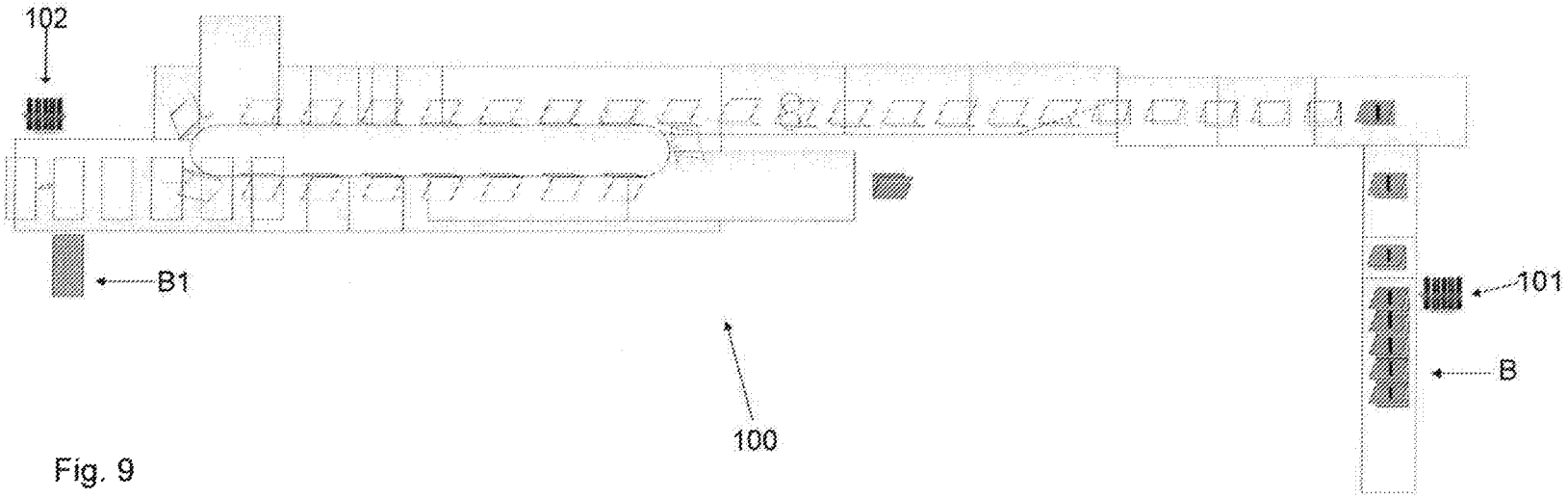

Following the finishing of the last printed product of the preceding job A (see FIG. 7), a withdrawal of empty covers B1 belonging to the following job B is initiated (see FIGS. 8, 9), thus ensuring that these covers are available for the printed products of the following job B.

Figure 10:
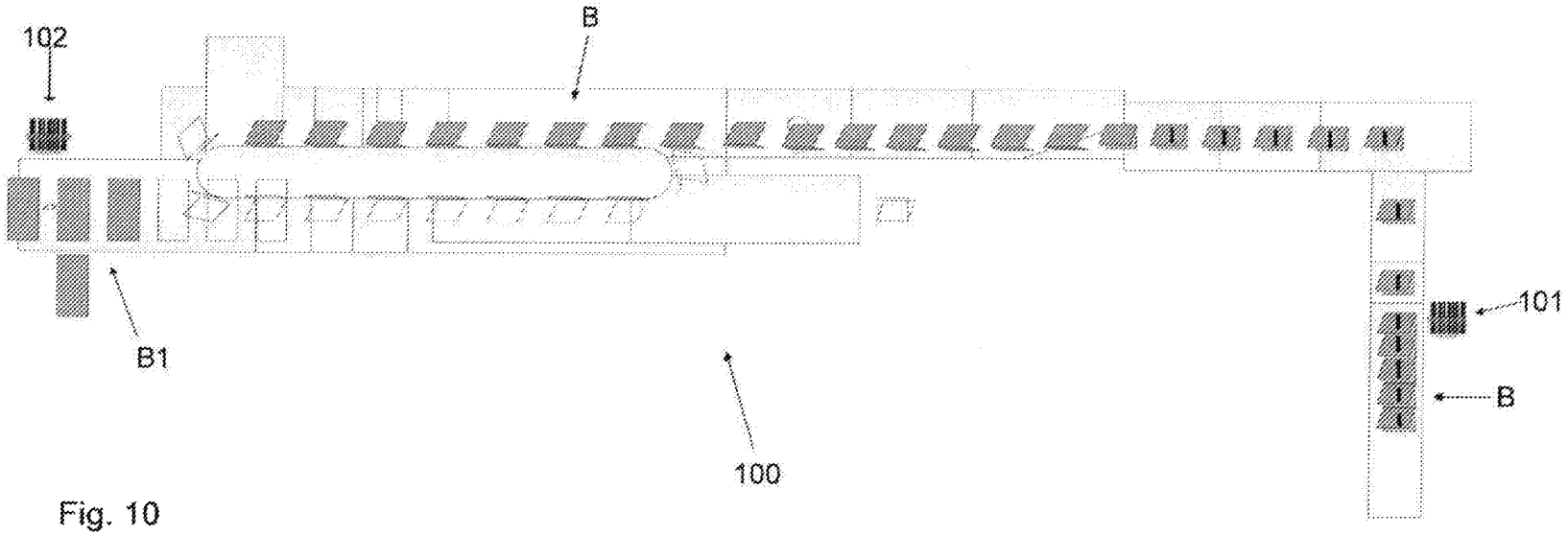
Figure 11:
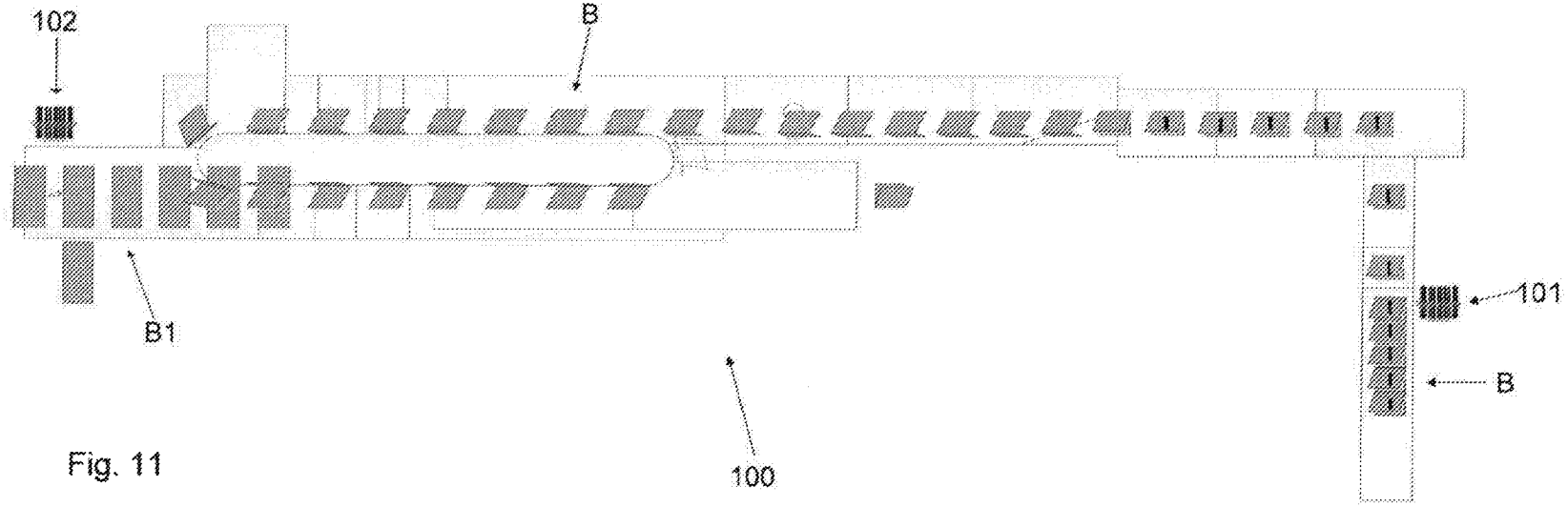

As soon as it has been determined that the withdrawn cover B1 securely matches the printed product of the following job B (see FIG. 10), the main control unit for the adhesive binder 3 releases the stopped printed products for the following job B (see FIGS. 8-10) which are then fed into the adhesive binder and are processed via its processing stations (see FIG. 11).

Figure 12:
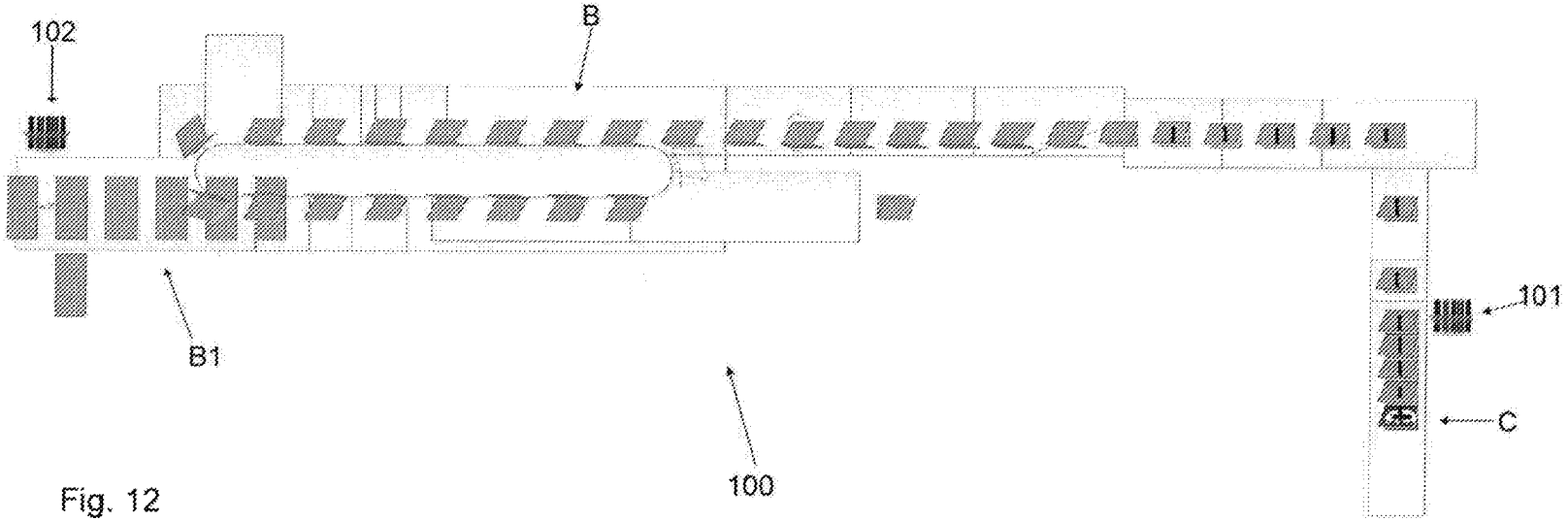

FIG. 12 finally illustrated the supplying of an additional job C (supplemented with a plus sign for a better characterization). In principle, the production in the adhesive binder 3 occurs here similarly or in the same way as described with the aid of FIGS. 2-11 in connection with jobs A and B. That is to say, job B then takes on the function of a preceding job as compared to job C, while job C assumes the position of a following job. The processes, however, remain the same, only the supplying of the covers for job C is not shown in this Figure. The manner in which the covers are supplied, however, is identical to the processes for the covers A1 and B1.

It will be understood that the above description of the present invention is susceptible to various modifications, changes and adaptations, and that the same are intended to be comprehended within the meaning and range of equivalents of the appended claims.

What is claimed is:

1. A method for producing adhesive-bound printed products in an adhesive-binder machine belonging to an adhesive-binder line, the an adhesive-binder machine having individual processing stations including a book spine processing station, an adhesive application station, and a pressing station with a cover that is withdrawn from a cover feeder, wherein the method for producing the adhesive-bound printed products is controlled by control profiles, the method comprising:

a) to changeover from one job under production to a following job, detecting supplied printed products of the following job via a barcode on the supplied printed products and stopping the following job prior to being fed into the machine of the adhesive-binder line;

b) moving and fully processing remaining printed products of the one job through the individual processing stations of the adhesive-binder machine while the printed products of the following job remain in a waiting position in front of the adhesive-binder machine;

c) after completing a last printed product of the one job, initiating an empty withdrawal of covers stored in a cover deposit and belonging to the following job until it is ensured that the stored covers are available for the printed products of the following job; and d) after determining that a withdrawn cover securely matches the printed products of the following job, releasing, with a main control of the adhesive-binder line, stopped printed products of the following job, and feeding the released printed products into the adhesive-binder machine for being processed via the individual processing stations.

2. The method according to claim 1, wherein before the releasing of the stopped printed products belonging to the following job, ensuring that at least one stored cover that matches the printed products is withdrawn empty.

3. The method according to claim 1, wherein prior to releasing the stopped printed products for the following job, ensuring that the stored cover for the printed products of the following job is detected and is immediately available without empty withdrawal.

4. The method according to claim 1, wherein prior to releasing the stopped printed products of the following job, ensuring that all excess covers belonging to the one job are withdrawn empty from the cover feeder until a matching cover for the printed products of the following job is detected.

5. The method according to claim 1, wherein excess covers of the one job are withdrawn empty until the stored cover for the printed products of the following job is detected and is available without empty withdrawal.

6. The method according to claim 1, further including converting the processing stations of the an adhesive-binder machine for producing the printed products of the following job by activating the control profiles for the following job before the stopped printed products belonging to the following job are released.

7. The method according to claim 1, wherein the processing of any further job is based on the same processing steps as for the following job that initially follows the one job.

8. The method according to claim 1, further including minimizing stopping times indicated by the stopped printed products for the following job by electronically detecting via barcodes a sequence of the stored covers and transmitting resulting information to a main control unit for the adhesive-binder machine to release the stopped printed products.

9. The method according to claim 8, further comprising determining a sequence of the printed products fed into the adhesive-binder machine by a sequence of the available covers.

10. The method according to claim 1, wherein with identically dimensioned printed products for different jobs which require different covers, no conversion takes place at the processing stations of the machine.

11. The method according to claim 1, wherein if the original thickness of the printed product changes for different jobs, original settings for the processing stations of the an adhesive-binder machine remain unchanged up to a minimum range of +/−3.25 mm.

12. The method according to claim 11, further comprising adapting at least one processing station of the adhesive-binder machine if the original product thickness changes for different jobs changes, exceeding the minimum range of +/−3.25 mm.

13. The method according to claim 11, further comprising converting the processing stations of the adhesive-binder machine if the format, including one of width or height, of the printed product changes or if the thickness difference immediately exceeds the minimum range of +/−3.25 mm.

14. The method according to claim 1, further comprising changing a geometric location for affixing grooves on the covers with a change in the book block thickness for the printed products.

15. The method according to claim 1, wherein the cover is made of an inflexible material, and further comprising providing the cover with two folds separated by a book block thickness.

16. The method according to claim 1, for a change in the dimensions of the printed products, the method further comprises, converting at least the processing stations of the adhesive-binder machine to measurements of the following job based on control profiles stored in a main control unit or which are computed, said converting taking place continuously at each processing station as soon as the last printed product of said one job has left a respective one of the processing stations.

17. The method according to claim 1, further comprising:

controlling processes for producing the adhesive-bound printed products via control profiles;

scanning in externally ahead of time barcode information on covers belonging to printed products and electronically transmitting the barcode information obtained about the covers, including a sequence of the scanned covers, to a main control unit for the adhesive-binder machine and/or the other machines in the adhesive-binder line, wherein a sequence for printed products released for processing corresponds to the sequence of the scanned-in covers.

18. The method according to claim 1, comprising the following machines and processing stations:

a collating machine for supplying printed products;

a machine with transfer elements located downstream of the collating machine for receiving and transferring the printed products;

an adhesive-binder machine arranged downstream of the transfer elements for receiving the printed products, the adhesive-binder machine including at least a book spine processing station, an adhesive application station, a cover feeding station, and a pressing station for adhesively binding a cover to a supplied printed product;

a discharge machine, which also functions as a cooling section arranged downstream of the adhesive-binder machine for receiving bound printed products from the adhesive-binder machine;

a three-way trimmer machine arranged downstream of the discharge machine for trimming the bound printed products;

a stacking machine arranged downstream of the three-way trimmer to stack the bound printed products; and a book data acquisition device to input job orders based on different criteria to control the machines and stations of the adhesive-binder line.

19. The method according to claim 18, comprising operating the individual stations of the adhesive-binder machine with a central drive shaft that extends through the complete adhesive-binder machine to form the drive of the individual processing stations of the adhesive-binder machine.

20. The method according to claim 18, comprising operating the individual stations of the adhesive-binder machine with at least one separate drive for each station.

21. The method according to claim 18, comprising controlling a pressing on of a cover inside the pressing station of the adhesive-binder machine by an adjustable pressing moment.

22. The method according to claim 18, comprising operating the processing stations of the adhesive-binder machine and complementary units or elements connected to the adhesive-binder machine with aid of job-dependent control profiles, which are transmitted by a main control unit or are integrated into drive units of the processing stations, or operating the processing stations of the adhesive-binder machine based on control profiles derived from closed-loop control processes.

* * * * *